United States Patent [19]

Watanabe

[11] Patent Number: 4,529,499

[45] Date of Patent: Jul. 16, 1985

[54] METHOD FOR PRODUCING MESOPHASE PITCH

[75] Inventor: Masami Watanabe, Tokyo, Japan

[73] Assignee: Kashima Oil Company Limited, Tokyo, Japan

[21] Appl. No.: 507,586

[22] Filed: Jun. 24, 1983

[51] Int. Cl.[3] ..... C10C 1/00

[52] U.S. Cl. ..... 208/44; 208/39; 208/40; 208/22

[58] Field of Search ..... 208/44, 40, 39, 22

[56] References Cited

U.S. PATENT DOCUMENTS

| | | | |
|---|---|---|---|
| 3,928,170 | 12/1975 | Takahashi | 208/40 |
| 3,974,264 | 8/1976 | McHenry | 423/447.4 |
| 3,976,729 | 8/1976 | Lewis et al. | 423/447.6 |
| 4,005,183 | 1/1977 | Singer | 208/44 |
| 4,026,788 | 5/1977 | McHenry | 208/40 |
| 4,032,430 | 6/1977 | Lewis | 423/447.1 |
| 4,209,500 | 6/1980 | Chwastiak | 208/44 |
| 4,303,631 | 12/1981 | Lewis et al. | 423/447.1 |
| 4,317,809 | 3/1982 | Lewis et al. | 208/39 |

FOREIGN PATENT DOCUMENTS

| | | | |
|---|---|---|---|
| 0044714 | 1/1981 | European Pat. Off | 208/44 |
| 0027739 | 4/1981 | European Pat. Off. | 208/44 |
| 102690 | 8/1980 | Japan | 208/40 |
| 47385 | 3/1982 | Japan | 423/447.2 |
| 2099845 | 12/1982 | United Kingdom | 208/22 |

*Primary Examiner*—D. E. Gantz
*Assistant Examiner*—Helane Myers
*Attorney, Agent, or Firm*—Armstrong, Nikaido, Marmelstein & Kubovcik

[57] ABSTRACT

A method for producing a 100% mesophase composed only of Q.I. component and Q.S. component is provided. This method comprises forming mesophase by the heat treatment of petroleum-origin pitch, subjecting the heat-formed pitch to a condition of heating under quiescent state to cause only the mesophase in the heat-formed pitch to grow and coalesce, separating only the non-mesophase of the upper layer and repeating the operation of the heat treatment and maintenance of heating under a quiescent state by the separated non-mesophase, as a raw material.

2 Claims, No Drawings

METHOD FOR PRODUCING MESOPHASE PITCH

This invention relates to a method for producing a 100% mesophase pitch composed of only Q.I. and Q.S. components as a raw material for high strength, high modulus carbon fibers. More particularly, it relates to a method for producing a 100% mesophase pitch which enables us to produce with a high efficiency and at a low price, high strength, high modulus carbon fibers which are preferable as a raw material for composite articles.

BACKGROUND OF THE INVENTION

As the result of recent rapid growth of industries for manufacturing aircrafts, motor vehicles and other transport, the demand for materials capable of exhibiting remarkable characteristics because of the superiority of some of their physical properties is ever increasing. Particularly, the demand for the advent of inexpensive materials provided with high strength and high modulus together with lightness of weight is great. However, since the material which satisfies the above-mentioned demand cannot be supplied in a stabilized manner according to the present status of art, research works relative to composite articles (reinforced resins) which meet the above-mentioned requirement are prevailing.

As one of the most promising material to be used as a reinforced resin, there can be mentioned high strength high modulus carbon fibers. These materials have appeared from about the time when the rapid growth of the above-mentioned industry just started. When the carbon fibers are combined with a resin, it is possible to produce reinforced resins capable of exhibiting characteristic feature unparalleled in the past. To be regretful enough, however, in spite of the high strength and high modulus of the carbon fibers for the above-mentioned reinforced resins capable of exhibiting extremely notable characteristic feature, the application fields of these fibers have not expanded. The cause of this fact, as explained later, lies in the higher production cost.

It is well known that the material for high strength, high modulus carbon fibers which are commercially available are mostly polyacrylonitrile fibers produced by a special production process and a special spinning process but these acrylonitrile fibers are not only expensive as a raw material but also the production yield thereof from these raw material is as low as less than 45%. These facts complicate the treatment steps for producing superior carbon fibers, resulting in the increasing production cost of the ultimate products of carbon fibers.

As for the methods for producing inexpensive raw materials for carbon fibers, there are many reports such as U.S. Pat. No.3,974,264 and U.S. Pat. No.4,026,788 both issued to E. R. McHenry and assigned to Union Carbide Corporation, etc. Beside these, there are many reports in the official gazettes of patent publications. According to these methods, petroleum origin pitch or tar-origin pitch is subjected to heat treatment at a temperature of 380° C. to 440° C. to produce a pitch containing 40% to 90% preferably 50% to 65% mesophase and resulting products are used, as they are, for raw materials for carbon fibers. Accordingly, these products contain a large amount of non-mesophase pitch and cannot be called as a 100% mesophase pitch which is required as a raw material for high strength, high modulus carbon fibers and is not provided with the characteristic properties of a 100% mesophase pitch.

Further there is a method which is directed to the production of a mesophase, claiming to be essentially 100% mesophase, in the official gazette of Japanese laid open Pat. No.55,625 of 1979. According to this method, inert gas such as nitrogen, argon, xenon, helium, steam, etc. in a very large amount e.g. at least 8l per kg raw material is introduced under pressure into isotropic pitch which is then subjected to heat-treatment at a temperature of 380° C. to 430° C., with vigorous stirring even for 5 to 44 hours, until it is converted into a single phase system. Thus an attempt is made to produce a so-called 100% mesophase pitch. However, the isotropic pitch of raw material is of a so-called huge molecule, complicated and not a pure compound. It contains impurities and forms emulsion. No matter how long a time, inert gas is compressed into and no matter how vigorous stirring treatment is applied to the pitch, it is impossible to simplify the emulsion completely. In any way, it is impossible to avoid the mixing of non-reacted isotropic pitch, completely and resulting product cannot be said to be a 100% mesophase.

It is an object of the present invention to provide a method for producing high strength and high modulus carbon fibers preferable as a raw material for fabricating composite articles efficiently and at an inexpensive cost.

The above-mentioned object can be attained by the method of the present invention in which a residuum carbonaceous material formed, as a by-product of a catalytic cracking of vacuum gas oil (F.C.C.) or a thermal cracking of naphtha is heated with stirring under a stream of a hydrocarbon gas of small numbers of C. atom, lower melting point naphtha fractions or a dry gas which is formed as a by-product at the time of heat treatment of the raw material of the present invention, under the atmospheric or superatmospheric pressure, at a heating temperature of 360°~450° C. for a heating time of 30 minutes to 30 hours so as to bring the mesophase content in the heat-formed pitch in the range of 10 to 50%, then holding the heat-formed pitch in the quiescent aging state under a stream of a hydrocarbon gas of small numbers of C. atom, lower melting point naphtha fractions or a dry gas which is formed as a by-product at the time of the heat treatment of the raw material, at a temperature of 290° C. to 350° C. for 5 to 30 hours, which is entirely different treatment condition from the heat treatment condition to divide and separate a non-mesophase of the upper layer and a mesophase of the lower layer by the difference of physical properties (e.g. specific gravity or viscosity) at the same temperature as that of the quiescent aging state and subjecting only the non-mesophase of the upper layer to the repetition of the above-mentioned heating operation and the operation of holding in the quiescent aging state to convert the non-mesophase pitch to the 100% mesophase composed only of Q.I. and Q.S. components to produce the 100% mesophase composed only of Q.I. and Q.S. component.

Petroleum origin pitch has many kinds and their properties are extremely complicated, but as the condition for carrying out heat treatment with stirring by using as a carrier gas a stream of a hydrocarbon gas of small numbers of carbon atom, lower boiling point fractions of naphtha or a dry gas which is formed, as a by-product of heat treatment of the raw materials of the present invention at atmospheric or superatmospheric pressure, or as the condition for bringing the content of mesophase in heat-formed pitch, in the range of 20%~40%, a heating temperature of 380° C. to 440° C. and a heating time of 30 minutes to 10 hours should be selected. Depending upon the kind of properties of raw material, it may be sometimes possible to subject raw material directly to heat treatment without producing a precursor. Further it has been found that if the upper layer and the lower layer are separated and the non-mesophase of the upper layer is repeatedly used, the mesophases in non-mesophase of upper layer become seed of reaction in heat treatment and shortens heating time. It is also found that as the condition for holding heat-formed pitch containing 20% to 40% mesophase, in quiescent state under stream of a hydrocarbon gas of small numbers of C-atom or the like, selection of quiescent temperature and time, respectively in the ranges of 300° C. to 340° C. and 10 to 30 hours which are conditions entirely different from those of heat treatment divides and separates non-mesophase layer in the upper layer (in which an extremely small amount of mesophase is mixed therein) from a 100% mesophase composed only of Q.S. and Q.I. components in the lower layer and separated a 100% mesophase composed only of Q.S. and Q.I. components in the lower layer (which can be confirmed by a polarization microscope) is composed of 2 mesophase components of Q.I. mesophase (quinoline insoluble which is measured by the extraction with quinoline at 80° C.) and Q.S. component (quinoline soluble). By causing this mesophase pitch to be present in the form of 75% to 85% Q.I. component and 13% to 25% Q.S. component simultanesously, spinning property of pitch can be improved.

The heating reaction for producing mesophase and the aging reaction for enlarging produced mesophase microbeads are entirely different and by treating these reactions separately, it is only possible to separate 100% mesophase and non-mesophase by the different physical properties (such as specific gravity, viscosity, etc.) at the temperature same as the aging and melt-coalescing temperature.

The upper layer of non-mesophase pitch separated from the lower layer is subjected to the operations of heat treatment and holding in quiescent aging state, to prepare a 100% mesophase composed only of Q.I. and Q.S. components.

The present invention is based upon the following three facts which have been discovered by the present inventor.

1. A raw material pitch is subjected to heat treatment under a stream of a hydrocarbon gas of small numbers of C-atom and to holding in quiescent aging state which is a condition entirely different from that of heat treatment to divide into a non-mesophase upper layer and a 100% mesophase lower layer and the non-mesophase upper layer can be a raw material for producing a 100% mesophase. In other words, a separated non-mesophase in the upper layer can be used repeatedly.

2. An extremely small amount of mesophase is mixed in the separated non-mesophase of the upper layer and these mesophases perform a function of seeds of reaction in the heat treatment and shorten heating time.

3. The separated 100% mesophase of the lower layer is composed only of Q.I. component and Q.S. component.

It is a very important point that the reason of separability of the non-mesophase of the upper layer from the 100% mesophase of the lower layer after the aging melt-coalescing has an intimate connections with the preceding heat-treatment condition in the present invention.

The two inventions entitled "Method for producing mesophase-containing pitch by using carrier gas", U.S. Ser. No. 507,585, and "Method for producing mesophase pitch", U.S. Ser. No. 507,584, both filed by the inventor of the present application on the same day with the present application, had been utilized in the present invention and the description of these applications are incorporated herein by reference.

One example for producing carbon fibers by spinning a 100% mesophase composed only of Q.I. and Q.S. components is presented as follows.

The fibers obtained by spinning a 100% mesophase at a spinning temperature of 320° C. and a viscosity of 50 poise (at the spinning temperature) and a spinning velocity of 100 m/min are subjected to thermosetting (crosslinking) with air at a temperature of 300° C. for 15 minutes and then subjected to carbonization at a temperature rising velocity of 10° C./min and at an ultimate temperature of 1400° C. for 15 minutes to produce carbon filament yarns having high strength and high modulus.

Following examples are set forth for the purpose of illustration for those skilled in the art but not for the purpose of limitation of the invention in any manner.

EXAMPLE 1

A residuum carbonaceous material which is formed as a by-product in a catalytic cracking process (F.C.C.) of vacuum gas oil having a boiling point higher than 470° C. was subjected to a heat-treatment carried out with stirring shown in the following table without being subjected to a preliminary heat-treatment. Then the operations of holding of heated pitch in quiescent aging state at a temperature of 300° C. for 20 hours were repeated followed by separation of 100% mesophase at the temperature, the same with that of quiescent state. At the time of heat treatment carried out with stirring, the gas formed during the time of heat-treatment was recycled for using as a non-oxidative gas stream.

Result of production of recycled mesophase under atmospheric pressure

| Experiment number | | 1 | 2 | 3 | 4 | 5 | 6 | 7 |
|---|---|---|---|---|---|---|---|---|
| Name of Sample | | | non-meso-of phase 1 | non-meso-of phase 2 | non-meso-of phase 3 | non-meso-of phase 4 | non-meso-of phase 5 | non-meso-of phase 6 |
| Sample (g) | | 1290 | 786 | 491 | 379 | 254 | 164 | 96 |
| Heating condition | temperature (°C.) | 400 | 400 | 400 | 400 | 400 | 400 | 400 |
| | time (hr) | 2°30′ | 2°00′ | 1°00′ | 1°00′ | 0°45′ | 0°30′ | 2°00′ |
| Pitch | formed amount (gr) | 1156 | 752 | 464 | 345 | 236 | 157 | |
| | yield (%) | 86.5 | 95.8 | 94.7 | 91.0 | 93.3 | 96.2 | |
| Distilled oil | formed amount (gr) | 101 | 31.4 | 25.6 | 27.8 | 7.8 | 4.5 | |

-continued

| Experiment number | | Result of production of recycled mesophase under atmospheric pressure 1 | 2 | 3 | 4 | 5 | 6 | 7 |
|---|---|---|---|---|---|---|---|---|
| | yield (%) | 86.5 | 95.8 | 94.7 | 91.0 | 93.3 | 96.2 | |
| Gas yield (wt %) | | 5.7 | 0.2 | 0.11 | 0.1 | — | — | |
| Mesophase (%) | | 18.9 | 25.4 | 12.0 | 20.8 | 23.4 | 24.6 | |
| Property of pitch | | non-meso / meso | non-meso / meso- | non-meso / meso- | non-meso / meso- | non-meso / meso- | non-meso / meso- | separation is insufficient |
| Yield of each phase | | 78.1 / 21.9 | 73.5 / 26.5 | 87.3 / 12.6 | 77.2 / 22.8 | 75.0 / 25.0 | 74.5 / 25.5 | |
| Flow test | softening point | 220 | 214 | 209 | 215 | 213 | 220 | 232 |
| | softening point corresponding to R & B | 284 | 271 | 64 | 269 | 264 | 271 | 286 |
| Mesophase fraction | Q.I. component (%) | 85.2 | 82.1 | 76.8 | 80.1 | 78.2 | 79.2 | |
| | Q.S. component (%) | 14.8 | 17.9 | 3.2 | 19.9 | 21.8 | 20.8 | |

The measurement of the softening points corresponding to R & B was carried out according to JISK-2531 r.p.m. of stirrer It is necessary to investigate sufficiently the condition for holding in quiescent aging state of heat-formed pitch for experiment number 7.

EXAMPLE 2

The pitch formed according to Experiment Number 4 of Example 1 was subjected to separation test of mesophase immediately after forming, at the following condition for holding in quiescent aging state under a stream of non-oxidative stream.

EXAMPLE 3

Residuum carbonaceous material formed as a by-product of thermal cracking of naphtha, having a boiling point of 290° C. was treated by the repetition of the following heat treatment condition. At the time of heat treatment carried out with stirring the gas formed as a by-product of the heat treatment was recycled to be used as a stream of hydrocarbon gas of small numbers of carbon atom.

| Experiment number | | Result of separation test of mesophase 8 | 9 | 10 | 11 | 12 | 13 |
|---|---|---|---|---|---|---|---|
| Holding in quiescent aging state | temperature (°C.) | 260 | 280 | 300 | 300 | 320 | 340 |
| | time (hr) | 10 | 10 | 10 | 20 | 10 | 10 |
| Property of pitch | | non-meso / meso | non-meso / meso- | non-meso / meso- | non-meso / meso- | non-meso / meso- | non-meso / meso |
| Yield of each phase | | unseparable | separation insufficient | 82.8 / 17.2 | 77.2 / 22.8 | | |
| Flow test | softening point (°C.) | | | 208 | 215 | 212 | 212 |
| | softening point (°C.) corresponding to R & B | | | 262 | 269 | 264 | 267 |
| Mesophase fraction | Q.I. component (%) | | | 76.8 | 80.1 | 78.2 | 78.6 |
| | Q.S. component (%) | | | 23.2 | 19.9 | 21.8 | 21.4 |

In experiment number 9, the boundary of non-mesophase and mesophase was not clearly formed and a large amount of mesophase microbeads is mixed therein. As a carrier gas a hydrocarbon gas of small numbers of carbon atom formed in heat treatment was employed.

As for condition for holding heat-formed pitch in quiescent aging state, aging temperature of 300° C. under a stream of hydrocarbon gas of small number of carbon atom and holding time of repetition of 20 hours were used in the treatment to produce mesophase.

| Experiment number | | Result of production of recycled mesophase under atmospheric pressure 14 | 15 | 16 | 17 |
|---|---|---|---|---|---|
| Name of sample | | | non-meso of 14 | non-meso of 15 | non-meso of 16 |
| Sample (gr) | | 1,200 | 490 | 280 | 170 |
| Heating condition | temperature (°C.) | 380 | 380 | 380 | 380 |
| | time (hr) | 2°30′ | 2°00′ | 1°00′ | 0°45′ |
| Pitch | formed amount (gr) | 660 | 422 | 265 | 158 |
| | yield (%) | 55.0 | 86.2 | 94.6 | 93.4 |
| Distilled oil | formed amount (gr) | 464 | 62 | 14 | 11 |
| | yield (%) | 38.7 | 12.6 | 4.9 | 6.5 |
| Gas yield (wt %) | | 6.3 | 1.2 | 0.4 | — |
| Yield of mesophase (%) | | 18.1 | 27.8 | 26.2 | 27.4 |
| Property of pitch | | non-meso / meso | non-meso / meso | non-meso / meso | non-meso / meso |
| Yield of each phase | | 79.8 / 20.2 | 71.6 / 28.4 | 72.6 / 27.4 | 72.2 / 27.8 |
| Flow test | softening point (°C.) | 148 / 226 | 153 / 222 | 152 / 216 | 158 / 218 |
| | softening point (°C.) | 282 | 274 | 280 | 284 |

-continued

| Experiment number | Result of production of recycled mesophase under atmospheric pressure | 14 | 15 | 16 | 17 |
|---|---|---|---|---|---|
| Mesophase fraction | corresponding to R & B Q.I. component (%) | 85.3 | 83.6 | 84.2 | 86.0 |
| | Q.S. component (%) | 14.7 | 16.4 | 15.8 | 14.0 |

What is claimed is:

1. A method for producing a 100% mesophase pitch composed only of Q.I. and Q.S. components with a softening point of about 208°to 220° C. which comprises steps of (i) subjecting a petroleum-origin pitch to heat treatment with stirring under a stream of a carrier gas selected from the group consisting of a hydrocarbon of small carbon numbers, a lower boiling point naphtha fraction or a dry gas by-product of the heat treatment of the raw material petroleum origin pitch and at atmospheric or super atmospheric pressure and a temperature of 360° C. to 450° C. until the mesophase content in the resulting pitch is in the range of 10% to 50%, (ii) holding said heat-treated pitch in quiescent aging melt-coalescing state at a temperature of higher than 280° C. and lower than 350° C., under a stream of gas selected from the group consisting of a hydrocarbon gas of small carbon atom numbers, lower melting point naphtha fractions and a dry gas formed as a by-product of the heat treatment of the raw material petroleum origin pitch, thereby dividing the heat-treated pitch into a non-mesophase and mesophase, (iii) separating a non-mesophase of the upper layer and a mesophase of the lower layer by the difference of physical properties at the same temperature as the aging melt-coasliscing temperature to produce the 100% mesophase composed only of Q.I. and Q.S. components, (iv) subjecting only the separated non-mesophase to the steps (i), (ii) and (iii), and repeating the step of (iv) at least three times by using only the separated non-mesophase each time.

2. A method for producing a 100% mesophase pitch according to claim 1, having a Q.I. of 75% to 85% & and a Q.S. of 13% to 25%.

* * * * *